US005501815A

United States Patent [19]

Man

[11] Patent Number: 5,501,815

[45] Date of Patent: Mar. 26, 1996

[54] PLASTICWARE-COMPATIBLE RINSE AID

[75] Inventor: Victor F. Man, Minneapolis, Minn.

[73] Assignee: Ecolab Inc., St. Paul, Minn.

[21] Appl. No.: 312,460

[22] Filed: Sep. 26, 1994

[51] Int. Cl.[6] ..... C11D 1/66; C11D 3/00; C11D 7/26; C11D 7/00

[52] U.S. Cl. ..... 252/174.17; 252/174.21; 252/174.22; 252/174.23; 252/DIG. 1; 252/DIG. 10; 252/DIG. 14

[58] Field of Search ..... 252/174.17, 174.21, 252/174.22, 174.23, DIG. 1, DIG. 10, DIG. 14

[56] References Cited

U.S. PATENT DOCUMENTS

| | | | |
|---|---|---|---|
| 3,925,241 | 12/1975 | Schmolka | 252/DIG. 13 |
| 4,624,713 | 11/1986 | Morganson et al. | 134/25.2 |
| 4,898,621 | 2/1990 | Pruehs et al. | 134/25.2 |
| 4,908,148 | 3/1990 | Caravajal et al. | 252/135 |
| 4,938,888 | 7/1990 | Kiefer et al. | 252/91 |
| 5,003,057 | 3/1991 | McCurry et al. | 536/186 |
| 5,114,717 | 5/1992 | Kuznitz et al. | 424/401 |
| 5,273,677 | 12/1993 | Arif | 252/174.21 |
| 5,318,728 | 6/1994 | Surutzidis et al. | 252/548 |
| 5,352,376 | 10/1994 | Gutzmann | 252/49.3 |
| 5,358,653 | 10/1994 | Gladfelter et al. | 252/90 |
| 5,366,654 | 11/1994 | Van Den Brom et al. | 252/174.17 |
| 5,374,369 | 12/1994 | Angevaare et al. | 252/102 |

FOREIGN PATENT DOCUMENTS

| | | | |
|---|---|---|---|
| 90203211.9 | 12/1990 | European Pat. Off. | C11D 1/66 |
| 4233698 | 4/1994 | Germany | C11D 3/20 |
| 88/09369 | 12/1988 | WIPO | C11D 17/00 |
| WO94/19438 | 9/1994 | WIPO | C10M 173/02 |
| 94/24256 | 10/1995 | WIPO | C11D 3/37 |

OTHER PUBLICATIONS

Block and Graft Copolymerization, John Wiley & Sons, vol. 2, pp. 31–37, 98–100 and 154–155 1976 (month not available).

Mobay Technical Marketing Information, Chemical Compatibility Test for Unreinforced Thermoplastic Resins (month not available).

*Primary Examiner*—Sharon Gibson
*Assistant Examiner*—Patricia L. Hailey
*Attorney, Agent, or Firm*—Merchant, Gould, Smith, Edell, Welter & Schmidt

[57] ABSTRACT

A plasticware-compatible low-foaming rinse aid and method for using such rinse-aid to effectuate sheeting of aqueous rinse liquid from solid surface. The rinse aid comprises alkyl polyglycoside (APG) and reverse, polyoxyethylene-containing polyoxyalkylene block copolymer. The aqueous rinse solution obtained by diluting the rinse aid with water is compatible with thermoplastics such as polycarbonate and polysulfone.

20 Claims, No Drawings

PLASTICWARE-COMPATIBLE RINSE AID

FIELD OF THE INVENTION

The present invention relates to rinse aid concentrates, aqueous rinse solutions used in rinsing ware, for example, dishes, and the use of such rinse aids and aqueous rinse solutions in warewashing.

BACKGROUND OF THE INVENTION

Automatic dishwashing machines, widely used in residential and commercial settings, have various dishwashing cycles, each of which is a combination of steps, such as soak, prewash, main wash, rinse, sanitize, and dry. The rinse step in a warewashing cycle uses rinse water (or aqueous rinse solution) to cause substantially complete drainage of residual detergent composition and loosened soil. Rinse aid concentrates containing a nonionic material; for example, a fatty alcohol ethoxylate, are sometimes dissolved in the rinse water (or aqueous rinse solution), particularly in institutional dishwashing machines, to minimize spotting and to promote faster drying by causing the rinse water to "sheet off" or drain from the cleaned ware, such as dishes, evenly and quickly after rinsing. See U.S. Pat. No. 4,624,713 (Morganson et al.) for a general description of the function of rinse aids.

Generally, foaming is undesirable in the rinse step of warewashing because foaming reduces the action of the rinse water and might lead to an overflow from the dishwashing machine. Therefore, low-foaming surfactants or surfactants with defoaming property are preferably used in rinse aids.

Many surfactants commonly used in rinse aids are neutral or acidic compounds. The mechanism through which a surfactant provides sheeting characteristics and faster draining of water from cleaned ware are not fully understood. However, a reduction of surface energy or interfacial tension between the liquid and the solid ware surface by the surfactants is an important factor.

Nonionic surfactants have often been used in rinse aids to improve sheeting. Morganson et al., U.S. Pat. No. 4,624,713, disclose a solid rinse aid containing a surfactant and urea. Morganson et al. found that polyoxypropylene-polyoxyethylene block copolymer comprising a center block of polyoxypropylene and having a block of polyoxyethylene to each side of the center polyoxypropylene block are useful surfactants for making their rinse aids. They also found that the "reverse PLURONIC" type surfactants having a center block of polyoxyethylene units with end blocks of polyoxypropylene units were also useful for the same purpose. The use of polyoxypropylene containing and polyoxyethylene-containing block copolymers in rinse aids is also disclosed by R. J. Ceresa in *Block and Graft Copolymerization,* vol. 2, pp.31–37, 98–100, 154–155, John Wiley and Sons (1976).

The washing of kitchenware and tableware, such as utensils, cups, spoons, forks, and the like, with detergents and rinse aids sometimes results in corrosion of the ware. Caravajal, U.S. Pat No. 4,908,148, discloses a liquid rinse additive composition that inhibits corrosion of glassware caused by washing with an automatic dishwashing detergent composition. Such a rinse additive composition contains a nonionic, polyoxyalkylene surfactant.

Today, many of the kitchenware and tableware, such as utensils, plates, and cups, are made of plastics such as polysulfone and polycarbonate. Under the washing conditions in a modern dishwasher, the plastic ware may undergo chemical attack by the dishwashing chemicals. See van de Brom, European Patent Application No. 90203211.9, filed on Dec. 6, 1990. Such chemical attack may result in stress cracking of the plastic ware. Stress cracks are the cracks that result when the plastic ware is exposed to chemicals (usually organic) that facilitate the release of the built-in stress (or frozen-in stress) in the plastic ware. Many conventional rinse aids have been found to contain components that are not compatible with plastic ware, i.e., they attack plastics and cause stress cracking. van de Brom discloses the use of alkyl polyglycosides (APGs) in a rinse aid that attack plastics to a lesser degree than rinse aids based on other types of nonionic surfactants. That application also discloses that a long chain ketone type anti-foam agent is preferably added to the composition while nonionic surfactants are not preferred in view of their limited compatibility towards polycarbonate.

SUMMARY OF TEE INVENTION

The invention provides a rinse aid that comprises one or more alkyl polyglycosides ("APGs") and one or more polyoxyalkylene nonionic block copolymers having three or more blocks. The polyoxyalkylene block copolymer contains at least one—$(EO)_e$—$(PO)_p$ group, a —$(EO)_e$—$(PO)_p$—R group, a —$(EO)_e$—$(BO)_b$ group or a —$(EO)_e$—$(BO)_b$—R group wherein e, p or b are 5 or more and R is a $C_2$alkyl. Useful classes of surfactant are (1) a reverse PLURONIC polyoxyethylene-containing polyoxyalkylene block copolymer, a block copolymer containing four blocks, a block copolymer containing five blocks, a block copolymer containing three or more arms and mixtures thereof.

This rinse aid contains an amount of the polyoxyalkylene block copolymer and APG sufficient, upon dilution with water, to form a low-foaming, aqueous rinsesolution with desirable sheeting characteristic useful for washing kitchenware and tableware, such as cups and forks, especially plastic ware such as polycarbonate and polysulfone, in automatic warewashing machines. Preferably, the nonionic, polyoxyalkylene block copolymer surfactant is a reverse PLURONIC type $(EO)_e$ and $(PO)_p$, e is a number at least 5 and p is a number at least 5, containing block copolymer having two or more end blocks comprising PO and at least one internal block comprising an alkylene oxide containing block such as EO or heteric or homopolymeric blocks of both. As used herein, "EO" refers to oxyethylene unit, i.e., —$(CH_2CH_2O)$— and "PO" refers to oxypropylene unit, i.e.:

$$-(CH_2-\underset{}{\overset{CH_3}{\overset{|}{CH}}}-O)_n-$$

"BO" refers to an oxybutylene unit, i.e.:

$$-(CH_2-\overset{CH_2CH_3}{\overset{|}{CH}}-O)_n-$$

wherein n is 5 or more; and the term "Polyoxyalkylene block copolymer" refers to a polymer consists substantially of polyoxyalkylene polymer blocks each of a single oxyalkylene monomer units covalently bonded together, wherein the oxyalkylene monomer units in adjacent blocks are dissimilar. The term "—$(EO)_e$—$(PO)_p$ polyoxyalkylene block copolymer" refers to a block copolymer comprising block of polyoxyethylene (or multiunits of EO) and block of polyoxypropylene (or multiunits of PO). The subscripts e and p each represents the number of monomer units in the respective block. The term "reverse—$(EO)_e$—containing block copolymers" refers to block copolymers that comprise an $(EO)_e$ block and a block of another polyoxyalkylene (such as polyoxypropylene or polyoxybutylene) bonded together and the end blocks in the chain of blocks are the blocks of the other polyoxyalkylene. A "rinse aid" or "rinse agent composition" refers to a composition containing rinse agent(s) which is added as an additive to water to make an aqueous rinse solution. The term "aqueous rinse or rinse composition" is a dilute solution of the rinse aid that contacts the ware directly. "Ware" refers to food-contacting items or articles used for the preparation or eating of food, including kitchenware and tableware, used for cooking and serving food, such as cooking utensils, cups, dishes, saucers, spoons, knives, forks, pots, pans, etc. The term "chemically compatible" or "compatible" is used to describe the absence of a tendency to significantly form stress cracks or weaken the plastic by exposure to organic solvents or solutions containing dissolved organic compounds.

The rinse aid of the present invention contains sufficient amounts of APG and nonionic, reverse polyoxyethylene-containing polyoxyalkylene block copolymer effective for diluting to a concentration typical of rinse solution containing commercially available rinse aids to effect desired sheeting, low-foaming and thermoplastic-compatibility characteristics.

The aqueous rinse solution derived from a rinse aid of the present invention containing APG and the reverse, polyoxyethylene-containing polyoxyalkylene block copolymer exhibits synergistic enhancement of both the sheeting effect and thermoplastic-compatibility over either the APG per se or the polyoxyalkylene block copolymer per se. Because of this synergistic effect, less of the rinse aid is needed to produce good sheeting. The aqueous rinse solution is compatible with thermoplastics such as polysulfone and polycarbonate in that they result in less stress crack damage than aqueous rinse solutions containing other conventional ingredients, such as those used in commercially available rinse aids, e.g., normal-type polyoxyethylene-polyoxypropylene block polymers.

DETAILED DESCRIPTION OF THE INVENTION

An "aqueous rinse solution" is an aqueous solution used for rinsing ware after washing, typically utilizing an automatic warewashing machine that has a means for automatically diluting a rinse aid to produce the aqueous solution at a desired concentration. The term "rinse agent" refers to a chemical agent, such as a fatty alcohol ethoxylate, that is contained in the aqueous rinse solution for lowering the interfacial tension between a solid surface and the aqueous rinse solution. On a smooth surface, a good aqueous rinse solution forms a smooth layer on the solid surface and drains or falls off the surface without leaving visible spot-forming droplets adhering to the surface. This process is called "sheeting," which is facilitated by the lowering of surface tension of the rinse solution. As previously stated, the rinse aid and aqueous rinse solution both contain alkyl polyglycoside and a reverse polyoxyethylene-containing polyoxyalkylene block copolymer.

Alkyl Polyglycosides (APGs)

Alkyl polyglycosides (APGs), also called alkyl polyglucosides if the saccharide moiety is glucose, which can be used in the present invention, are naturally derived, nonionic surfactants.

The alkyl polyglycosides, which can be used in the present invention, are fatty ether derivatives of saccharides or polysaccharides which are formed when a carbohydrate is reacted under acidic condition with a fatty alcohol through condensation polymerization. The APGs commonly are derived from corn-based carbohydrates and fatty alcohols from natural oils in animals, coconuts and palm kernels. Such methods of deriving APGs are known in the, art, for example, U.S. Pat. No, 5003,057 (McCurry), and the description therein on the methods of making glycosides and chemical properties are incorporated by reference herein.

The alkyl polyglycoside that can be used in the present invention contains a hydrophilic group derived from carbohydrates and is composed of one or more anhydroglucose. Each of the glucose units can have two ether oxygens and three hydroxyl groups and a terminal hydroxyl group, imparting water solubility to the glycoside. The presence of the alkyl carbons leads to the hydrophobic activity. When carbohydrate molecules react with fatty alcohol molecules, alkyl polyglycosides molecules are formed with single or multiple anhydroglucose units, which are termed monoglycosides and polyglycosides, respectively. The final alkyl polyglycoside product typically has a distribution of varying concentration of glucose units (or degree of polymerization).

The APG used in the formulation of the rinse aid of this invention preferably comprises the saccharide or polysaccharide groups (i.e, mono-, di-, tri-, etc. saccharides) of hexose or pentose, and a fatty aliphatic group with 6 to 20 carbon atoms. Alkyl polyglycosides which can be used in the present invention are represented by the general formula of $$(G)_x—O—R \qquad \text{I}$$

where G is a moiety derived from a reducing saccharide containing 5 of 6 carbon atoms, e.g., pentose or hexose; R is fatty aliphatic group containing 6 to 20 carbon atoms; and x is the degree of polymerization (D.P.) of the polyglycoside, representing the number of monosaccharide repeating units in the polyglycoside. Generally, x is an integer on the basis of individual molecules, but because there are statistical variations in the manufacturing process of the APG, x may be a noninteger on an average basis when referred to APG used as an ingredient for the rinse aid of the present invention. In this invention, x preferably has a value of less than 2.5, and more preferably is within the range between 1 and 2.

Exemplary saccharides from which G is derived are glucose, fructose, mannose, galactose, talose, gulose, allose, altrose, idose, arabinose, xylose, lyxose and ribose. Because of the ready availability of glucose, glucose is preferred in the making of polyglycosides. The fatty aliphatic group, which is the substituent of the preferred polyglycoside, is preferably saturated, although unsaturated fatty group may be used.

Generally, commercially available polyglycosides have alkyl chains of $C_8$ to $C_{16}$ and average degree of polymerization of 1.4 to 1.6. In this invention, specific alkyl polyglycosides will be described as illustrated in the following way: "$C_{12-16}$ G 1.4" denotes a polyglycoside with an alkyl chain of 12 to 16 carbon atoms and an average degree of polymerization of 1.4 anhydroglucose units in the alkyl polyglycoside molecule. Commercially, alkyl polyglycosides can be provided as concentrated, aqueous solutions ranging from 50 to 70 wt-% active. Examples of commercial suppliers of alkyl polyglycosides are Henkel Corp. and Union Carbide Corp.

Table 1 shows examples of commercially available (from Henkel Corp.) alkyl polyglycosides that can be used in the present invention. The number of carbons in the alkyl groups and the average degree of polymerization in the APGs are also shown in Table 1. The average degree of polymerization of saccharides in the APG listed varies from 1.4 to 1.7 and the chain lengths of the aliphatic groups are between $C_{8-10}$ and $C_{12-16}$.

The rinse aid of the present invention has the advantage of having less adverse impact on the environment than conventional rinse aids. Alkyl polyglycosides used in the present invention exhibit low oral and dermal toxicity and irritation on the mammalian tissues, which make them particularly suitable for use on food-contacting ware. These alkyl polyglycosides are also biodegradable in both anaerobic and aerobic conditions and they exhibit low toxicity to plants, thus improving the environmental compatibility of the rinse aid of the present invention. Because of the carbohydrate property and the excellent water solubility characteristics, alkyl polyglycosides are compatible in high caustic and builder formulations.

TABLE 1

Examples of alkyl polyglycosides (Henkel Corp.)

| Alkyl Polyglycoside | Henkel Surfactant | Ratio of APGs with Various Chain Lengths |
|---|---|---|
| $C_{8-10}$ G 1.7 | APG 225 | $C_8$:$C_{10}$ (45:55) |
| $C_{9-11}$ G 1.4 | APG 300 | $C_9$:$C_{10}$:$C_{11}$ (20:40:40) |
| $C_{9-11}$ G 1.6 | APG 325 | $C_9$:$C_{10}$:$C_{11}$ (20:40:40) |
| $C_{12-16}$ G 1.4 | APG 600 | $C_{12}$:$C_{14}$:$C_{16}$ (68:26:6) |
| $C_{12-16}$ G 1.6 | APG 625 | $C_{12}$:$C_{14}$:$C_{16}$ (68:26:6) |

In Table 1, the "Ratio of APGs with Various Chain Lengths" is the ratio by weight of the amount of APG of two different alkyl chain lengths in the commercially available APG sample. For example, $C_8$:$C_{10}$ (45:55) means about 45% of the APGs in the sample have alkyl chain length of 8 carbon atom and about 55% of the APGs in the sample have alkyl chain length of 10 carbon atoms. The APGs listed in Table 1 have moderate sheeting characteristics and are chemically compatible with thermoplastics such as polycarbonate and polysulfone. Because of the normal tendency of APGs to be foamy, defoamers such as long-chain ketone defoamers can be used with APGs. It is desirable that the defoamer also contributes to superior sheeting and is chemically compatible with thermoplastics. Reverse —$(EO)_e$— containing block copolymers are the preferred defoamers in the present invention.

The amount of APG present in the rinse aid of the present invention is sufficient to result in desired sheeting and plastic-compatible characteristics in corporation with an effective defoaming amount of a reverse polyoxyalkylene copolymer when such a rinse aid is diluted to a concentration typical of aqueous rinse solutions containing commercially available rinse aids. Such aqueous rinse solution generally contains more than five parts of the rinse aid per million parts of the aqueous rinse solution. Preferably, APG constitutes about 5% to 95%, more preferably about 5% to 10%, by weight of the rinse aid of the present invention. More than one APG can be used in place of one APG in the formulation of the rinse aid and the aqueous rinse solution.

The nonionic, reverse, polyoxyethylene-containing polyoxyalkylene block copolymer(s) preferably constitutes about 5% to 95%, more preferably about 5% to 40%, by weight of the rinse aid.

Reverse Polyoxyalkylene Block Copolymer

As previously stated, the rinse aid of the present invention contains nonionic, reverse- (or inverted) type, $(EO)_e$-containing, polyoxyalkylene block copolymer(s) (also known as alkoxylated block copolymer(s)). The reverse polyoxyalkylene block copolymers, especially —$(EO)_e$—$(PO)_p$ block copolymers, are effective in preventing or minimizing any normal foaming activity or characteristic of APGs, which is quite foam-forming by itself. Unlike many defoamers, the reverse polyoxyalkylene block copolymer is capable of enhancing the sheeting characteristics of the aqueous rinse solution. It has been found that regarding chemical attack on thermoplastics, such as polycarbonate and polysulfone, the reverse polyoxyalkylene block copolymers have better thermoplastic compatibility than the normal-type polyoxyalkylene block copolymers, which have end. blocks of —$(EO)_e$ in the polyoxyalkylene block copolymer chain. Because of their better water-solubility characteristics, the reverse polyoxyethylene-polyoxypropylene (i.e., reverse —$(EO)_e$—$(PO)_p$) block copolymers are preferred over other reverse polyoxyalkylene block copolymers, such as those that contain polyoxybutylene blocks.

The polyoxyalkylene block copolymers useful in the present invention can be formed by reacting alkylene oxides with initiators. Preferably, the initiator is multifunctional because of its use results in "multibranch" or "multiarm" block copolymers. For example, propylene glycol (bifunctional), triethanol amine (trifunctional), and ethylenediamine (tetrafunctional) can be used as initiators to initiate polymerization of ethylene oxide and propylene oxide to produce reverse block copolymers with two branches (i.e., arms or linear units of polyoxyalkylenes), three branches, and four branches, respectively. Such initiators may contain carbon, nitrogen, or other atoms to which arms or branches, such as blocks of polyoxyethylene $(EO)_e$, polyoxypropylene $(PO)_p$, polyoxybutylene $(BO)_b$, —$(EO)_e$—$(PO)_p$, —$(EO)_e$—$(BO)_b$, or —$(EO)_3$—$(PO)_p$—$(BO)_b$, can be attached. In such a copolymer, a larger amount of $(EO)_e$ results in higher water-solubility and a larger amount of $(PO)_p$ or $(BO)_b$ improves the thermoplastic compatibility of the copolymer. The amount of $(EO)_e$, $(PO)_p$, and $(BO)_b$ in the block copolymer can be selected such that the reverse block copolymer is water-soluble at a concentration typically used in an aqueous rinse solution and compatible with thermoplastics.

In the reverse block copolymer of the present invention, preferably, the arms or chains of polyoxyalkylenes that are attached to the residues of the initiators contain end blocks of —$(EO)_x$—$(PO)_y$, which have ends of polyoxypropylene (i.e., —$(PO)_y$), wherein x is about 1 to 1000 and y is about 1 to 500, more preferably x is about 5 to 20 and y is about 5 to 20.

The reverse block copolymer can be a straight chain, such as a three-block copolymer, $$(PO)_y—(EO)_x—(PO)_y \qquad \text{II}$$

wherein x is about 1 to 1000, preferably about 4 to 230; and y is about 1 to 500, preferably about 8 to 27. Such a copolymer can be prepared by using propylene glycol as an initiator and adding ethylene oxide and propylene oxide. The polyoxyalkylene blocks are added to both ends of the initiator to result in the block copolymer. In such a linear block copolymer, generally the central $(EO)_x$ contains the residue of the initiator and x represents the total number of EO on both sides of the initiator. Generally, the residue of the initiator is not shown in a formula such as II because it is insignificant in size and in contribution to the property of the molecule compared to the polyoxyalkylene blocks. Likewise, although the end block of the polyoxyalkylene block copolymer terminates in a —OH group, the end block is represented by —$(PO)_p$, —$(EO)_x$, —$(PO)_y$, and the like, without specifically showing the —OH at the end. Also, x, y, and z are statistical values representing the average number of monomer units in the blocks.

The reverse polyoxyalkylene block copolymer can have more than three blocks, an example of which is a five-block copolymer, $$(PO)_z—(EO)_y—(PO)_x—(EO_y—(PO)_z \qquad \text{III}$$

wherein x is about 1 to 1,000, preferably about 7 to 21; y is about 1 to 500, preferably about 10 to 20; and z is about 1 to 500, preferably about 5 to 20.

A chain of blocks may have an odd or even number of blocks. Also, in other embodiments, copolymers with more blocks, such as, six, seven, eight, and nine blocks, etc., may be used as long as the end polyoxyalkylene block is either $(PO)_p$ or $(BO)_b$.

As previously stated, the reverse $—(EO)_e—(PO)_p$ block copolymer can also have a branched structure having a trifunctional moiety T, which can be the residue of an initiator. The block copolymer is represented by the formula:

$$\begin{array}{l} \qquad\qquad\qquad\qquad (PO)_x—(EO)_y—(PO)_z \\ (PO)_z—(EO)_y—(PO)_x—T \\ \qquad\qquad\qquad\qquad (PO)_x—(EO)_y—(PO)_z \end{array} \qquad \text{IV}$$

wherein x is about 0 to 500, preferably about 0 to 10; y is about 1 to 500, preferably about 5 to 12, and z is about 1 to 500, preferably about 5 to 10.

One example of trifunctional initiators that can produce such branched structures is triethanol amine, $N(CH_2CH_2OH)_3$, which results in a branched block $—(EO)_e—(PO)_p$ copolymer $$\begin{array}{l} \qquad\qquad\qquad\qquad (CH_2CH_2O)—(PO)_x—(EO)_y—(PO)_z \\ (PO)_z—(EO)_y—(PO)_x—(OCH_2CH_2)—N \\ \qquad\qquad\qquad\qquad (CH_2CH_2O)—(PO)_x—(EO)_y—(PO)_z \end{array} \qquad \text{V}$$

where x is about 0 to 500, preferably about 0 to 10; and y is about 1 to 500, preferably about 5 to 12; and z is about 1 to 500, preferably about 5 to 10.

Other appropriate multifunctional initiators, for example, triols, can be carbon-based. One example of a copolymer resulting from such an initiator is:

$$\begin{array}{l} \qquad CH_2—O(PO)_x—(EO)_y—(PO)_z \\ \qquad\quad | \\ H—C—O(PO)_x—(EO)_y—(PO)_z \\ \qquad\quad | \\ \qquad CH_2—O(PO)_x—(EO)_y—(PO)_z \end{array} \qquad \text{VI}$$

wherein the value of x is about 0 to 10, y is about 5 to 12, and z is about 5 to 10.

An example of a reverse block copolymer with four polyoxyalkylene arms is:

$$\begin{array}{l} (PO)_y—(EO)_x \qquad\qquad\qquad\qquad (EO)_x—(PO)_y \\ \qquad\qquad\qquad N—CH_2—CH_2—N \\ (PO)_y—(EO)_x \qquad\qquad\qquad\qquad (EO)_x—(PO)_y \end{array} \qquad \text{VII}$$

wherein x is about 1 to 500, preferably about 1 to 100; and y is about 1 to 500, preferably about 8 to 32.

The branches in multi-arm (or multi-branch) structures can each contain more than two blocks as long as the end blocks are $—(PO)_p$ blocks or $—(PO)_p—R$, wherein R is a $C_{1-12}$ (lower) alkyl or a $—(BO)_b$ block with 1–5 moles of butylene oxide. Methods of making such polyoxyalkylene copolymers are known in the art and many such chemicals are commercially available (for example, TETRONIC R series from BASF Wyandotte Corporation). Table 2 shows the reverse $(EO)_e—(PO)_p$ block copolymers used in evaluation runs (see Examples below) illustrating thermoplastic-compatibility. The block copolymers of Table 2 have an ethylene oxide content of less than about 50 wt-% of the copolymer.

TABLE 2

| | $—(EO)_e—(PO)_p$ Block Copolymers Evaluated |
|---|---|
| Designation | Structure |
| Polymer-1 | $(PO)_{9.5}—(EO)_{13}—(PO)_{12.5}—(EO)_{13}—(PO)_{9.5}$ |
| Polymer-2 | $(PO)_{13}—(EO)_{16.5}—(PO)_{12.5}—(EO)_{16.5}—(PO)_{13}$ |
| Polymer-3 | $(PO)_{25.5}—(EO)_{35}—(PO)_{25.5}$ |
| TETRONIC 90R4 | $(PO)_{15.1}—(EO)_{16.5}$ … $(EO)_{16.5}—(PO)_{15.1}$; $N—CH_2—CH_2—N$; $(PO)_{15.1}—(EO)_{16.5}$ … $(EO)_{16.5}—(PO)_{15.1}$ |
| TETRONIC 50R4 | $(PO)_{9.75}—(EO)_{16.5}$ … $(EO)_{8.5}—(PO)_{9.75}$; $N—CH_2—CH_2—N$; $(PO)_{9.75}—(EO)_{16.5}$ … $(EO)_{8.5}—(PO)_{9.75}$ |
| GENAPOL PN30 | $(PO)_{9.9}—(EO)_{11.9}$ … $(EO)_{11.9}—(PO)_{9.9}$; $N—CH_2—CH_2—N$; $(PO)_{9.9}—(EO)_{11.9}$ … $(EO)_{11.9}—(PO)_{9.9}$ |
| PLURONIC 25R2 | $(PO)_{21.6}—(EO)_{14.2}—(PO)_{21.6}$ |
| PLURONIC L10 | $(PO)_{10}—(EO)_{11}—(PO)_{16}—(EO)_{11}—(PO)_{10}$ |
| Polymer-9 | $C_4H_9—(PO)_{5.3}—(EO)_{10.7}—(PO)_{20.7}—(EO)_{10.7}—(PO)_{5.3}—C_4H_9$ |

TABLE 2-continued

| | $-(EO)_e-(PO)_p$ Block Copolymers Evaluated |
|---|---|
| Designation | Structure |
| Polymer-10 | $\begin{array}{l} CH_2-O(PO)_9-(EO)_{11}-(PO)_5 \\ \quad\ \ \vert \\ H-C-O(PO)_9-(EO)_{11}-(PO)_5 \\ \quad\ \ \vert \\ CH_2-O(PO)_9-(EO)_{11}-(PO)_5 \end{array}$ |
| Polymer-11 | $(PO)_{11}-(EO)_{11}-(PO)_7-(EO)_{11}-(PO)_{11}$ |

Polymer-4 is TETRONIC 90R4, Polymer-5 is TETRONIC 50R4, Polymer-7 is PLURONIC 25R2, Polymer-8 is PLURONIC L10 obtained from BASF Wyandotte Corporation, and Polymer-6 is GENAPOL PN30 obtained from Hoechst Celanese Corporation. The nonionic, reverse polyoxyalkylene block copolymers used in the present invention preferably constitute about 5% to 95%, more preferably about 5% to 40%, by weight of the rinse aid, which also contains APG.

Although examples of reverse $(EO)_e$—$(PO)_p$ block copolymer (i.e., —$(EO)_e$—$(PO)_p$ block copolymers) are specifically described, other polyoxyalkylene block copolymers, such as —$(EO)_e$—$(BO)_b$ and —$(EO)_e$—$(PO)_p$—$(BO)_b$ block copolymers, and the like, can be applied in a similar manner as the —$(EO)_e$—$(PO)_p$ block copolymers with APGs for formulating thermoplastic compatible rinse aids and rinse solutions that have good sheeting characteristics. In such cases, the $(BO)_p$ blocks can take the place of some of the $(PO)_p$ blocks in the —$(EO)_e$—$(PO)_p$ block copolymers. It is understood that one skilled in the art can modify an organic compound with $(EO)_e$, $(PO)_p$, and $(BO)_b$ moieties in a way to obtain substances not specifically disclosed in the embodiments of the present invention to accomplish essentially the same function in the same way as the invention to attain low-foaming, good sheeting characteristics, and compatibility with thermoplastics such as polycarbonate and polysulfone.

As previously stated, the amount of the reverse $(EO)_e$—containing block copolymer used in the rinse aid of the present invention is effective to defoam the aqueous rinse aid solution, which contains APG to effect desired sheeting and thermoplastic compatibility characteristics when the rinse aid is diluted to a concentration typical of aqueous rinse solution derived from commercially available rinse aids. Preferably, the reverse $(EO)_e$—containing block copolymer constitutes about 5% to about 95% of the rinse aid, more preferably about 5% to 40%. A higher ratio of APG:reverse $(EO)_e$—containing block copolymer will provide a more environmental compatible but more foamy rinse aid. The ratio of APG:reverse $(EO)_e$—containing block copolymer in the rinse aid of the present invention is preferably about 1:20 to about 20:1, more preferably 1:5 to 2:1, and even more preferably about 1:3 to about 1:1, and most preferably about 1:3, which effects the best synergistic sheeting and thermoplastic-compatibility result with desirable low-foaming characteristic. The selection of the ratio, however, also depends on the availability of the two ingredients of the rinse aid, as well as economical considerations.

Using the Aqueous Rinse Aid

The rinse aid of the present invention will be typically diluted with water to produce a rinse solution effective for rinsing thermoplastic ware with desired sheeting, low-foaming and thermoplastic-compatibility characteristics. Typically, to make the aqueous rinse solution, the rinse aid to water ratio is about 5 ppm to about 1:10, preferably about 50 ppm to about 10,000 ppm. Water in the aqueous rinse solution of this invention solubilizes the chemical agent(s) in the rinse aid. Typically, the concentration of the active ingredients (i.e. APG and reverse polyoxyalkylene block copolymer) used for rinse aids in aqueous rinse solutions are in the range of 1 to 10,000 ppm, preferably 5 to 500, more preferably 15 to 125, most preferably 20 to 100ppm active component(s) of the rinse aid in aqueous diluent. As used herein, unless otherwise indicated, all concentrations in ppm refer to the concentrations of the active ingredients in the rinse aid. The balance of the aqueous rinse solution would be essentially water. Service (from municipal water utility) water, distilled water, deionized water, or the like may be used. Water is the preferred solvent because of its nontoxicity and ready availability.

Commonly known standard practices for utilizing rinse aids, such as directing water of a desired temperature through an eductor or venturi to draw the rinse aid for dilution, can be used for applying the rinse aid of the present invention. The rinse aid of the invention may be utilized in an automatic warewashing system without monitoring if a means for automatically diluting the rinse aid, such as the aforementioned eductor, to provide the aqueous rinse solution and a means for dispensing such a rinse solution are present in the warewashing system. The warewashing system may be an industrial warewashing system or a household dishwasher as long as such means are provided.

In addition, the rinse agent may be mixed with water equilibrated at a desired temperature at a desired concentration, and then the aqueous rinse solution is used for rinsing kitchenware and tableware such as utensils, cups, dishes, etc. Another preferred embodiment would be to use an automatic dispenser which draws simultaneously from the rinse aid and water at the same time, for example, by using two coordinated positive-displacement pumps to produce the aqueous rinse solution.

A. Evaluation of Sheeting of Various Surfactants or Combinations of Surfactants

Sheeting characteristics of aqueous rinse solutions derived from the rinse aids of the present invention were evaluated for comparison with aqueous rinse solutions derived from APGs, reverse polyoxyalkylene block polymers, or commercial rinse aids. In a series of runs, evaluation of sheeting performance of individual surfactants or combinations of surfactants were carried out as a function of concentration of the surfactants in the actual rinse cycles using a dishwashing machine. Foam levels were also observed. Table 2 shows examples of the rinse compositions containing the block copolymers evaluated. Table 3 shows examples of aqueous rinse solution formulations of the invention utilizing APGs and reverse polyoxyalkylene block copolymers. All of the formulations shown in Table 3 are stable up to 120° F.

TABLE 3

| | Content of Aqueous Rinse Aids, % | | | | | | | |
|---|---|---|---|---|---|---|---|---|
| | Formula | | | | | | | |
| Ingredient | (1) | (2) | (3) | (4) | (5) | (6) | (7) | (8) |
| Surfactants | | | | | | | | |
| APG 625 | 7.0 | 7.0 | 7.0 | 7.0 | 7.0 | 7.0 | 7.0 | 7.0 |
| Polymer-2 | 21.0 | 21.0 | 21.0 | 21.0 | 21.0 | 21.0 | — | 21.0 |
| Polymer-11 | — | — | — | — | — | — | 21.0 | — |
| Hydrotroyes | | | | | | | | |
| SXS, 40% | 70.0 | — | — | — | — | — | — | — |
| DOWFAX 3B2 | — | 10.0 | — | — | — | — | — | — |
| PETRO 22 | — | — | 10.0 | — | — | — | — | — |
| NAS-8D | — | — | — | 10.0 | — | — | — | — |
| PETRO AA | — | — | — | — | 10.0 | 30.0 | 30.0 | — |
| PETRO LBA | — | — | — | — | — | — | — | 30.0 |
| Preservative | | | | | | | | |
| KATHON CG/ICP | 0.10 | 0.10 | 0.10 | 0.10 | 0.10 | 0.10 | 0.10 | 0.10 |
| Dye SAP GREEN | .005 | .005 | .005 | .005 | .005 | .005 | .005 | .005 |
| Citric Acid, 50% | (small amount, typically 0.05%, to adjust to pH 7.0) | | | | | | | |
| Water | (balance) | | | | | | | |

In the formulations in Table 3, optional ingredients are included to facilitate the ease of utilization of the formulated rinse aids. For example, "KATHON CG/ICP" is a preservative effective for preserving APGs against microbial attack; "SAP GREEN" is a green dye; and SXS, DOWFAX 3B2, PETRO 22, NAS-8D, PETRO AA, and PETRO LBA are all commercially available anionic hydrotropes. Such anionic hydrotropes are useful for maintaining product stability and prevent phase separation over time, but do not contribute to any sheeting properties at the use concentrations. These anionic hydrotropes have been found to be "neutral" to plastics in that they do not protect or damage plastics. When the formulated rinse aids are diluted to the concentration typically used for rinsing ware, the optional ingredients are diluted to such a low concentration that they no longer perform any significant function.

The above formulations of Table 3 have been evaluated, and found to provide excellent sheeting with low foaming, especially those formulations with Polymer-2 ($PO_{13}$—$EO_{16.5}$—$PO_{12.5}$—$EO_{16.5}$—$PO_{13}$). Excellent sheeting was observed even on thermoplastic substrates which usually display less sheeting than other substrates such as china. Example I below shows the results of the sheeting evaluation.

The block copolymers of Table 2 and those in the formulations of Table 3, by themselves, are not as good in effecting sheeting for plastics as the formulations. Therefore, APG and the reverse —$(EO)_e$—$(PO)_p$ block copolymers together produced a synergistic effect in sheeting.

Example I

This example shows the result of water sheeting on thirteen different types of warewashing substrates. The substrates used for the evaluation include a polycarbonate dish, a polycarbonate tile, a glass tumbler, a glass plate, a polypropylene plate, a smooth polypropylene cup, a rough polypropylene cup, a polypropylene tray, a polyester tray, a polysulfone dish, and a polysulfone spoon. Meticulously cleaned substrates were used for the sheeting runs.

A solution containing 0.2% hotpoint soil was used to soil the substrates. The Hotpoint soil contained BLUEBONNET margarine and CARNATION non-fat dry milk at a ratio of 907 gm (2 lb) margarine to 227 gm non-fat dry milk. The aqueous hotpoint soil composition was prepared by adding the hotpoint soil into hot service water in a Champion 1KAB warewashing machine to a concentration of 0.2 wt%. The temperature of the water was about 160° to 180° F. The substrates were soiled by filling the warewashing machine with 0.2 wt% hotpoint soil and running the warewashing machine for 30 seconds. After the substrates were soiled, the water was drained from the machine and the substrates were removed from the warewashing machine. The warewashing machine was then filled with hot service water and cleaned by washing the warewashing machine with a 0.2 wt% detergent solution for three minutes and then with hot clean service water for three minutes.

The warewashing machine was then filled with hot service water and controlled at a temperature of 160° F. The substrates were then placed in the warewashing machine. The proper amounts of rinse additives were added to the wash water to achieve the desired concentrations in the wash water (or aqueous rinse solution). The warewashing machine was then turned on for about 30 seconds. The warewashing machine was then turned off and the water drainage of the substrates was observed by shining a light into the machine.

The result of water drainage is categorized as "pinhole sheeting" when tiny pinholes are observed to appear on the surface of the water draining off the substrate. The pinholes may increase slightly in size as the water continued to drain off the substrates. Some pinholes may close and new pinholes may form as water is being drained from the substrate. No droplets should be left on the surface of the substrate as the water is drained. Upon drying, no spots are left on the surface of the substrates.

The water drainage is categorized as "no sheeting" when water runs off the substrate in a random, irregular fashion. Water droplets are usually observed to clink to the substrate after draining.

The water drainage is categorized as "complete sheeting" when an unbroken sheet of water is observed to cling to the surface of the substrate with no holes or breakage of the water surface as the water continued to drain. No droplets are observed and no spots are left on the surface of the substrate after drying.

In categorizing the sheeting result, sheeting characteristic is considered to be excellent on a substrate if "complete sheeting" is observed. Sheeting characteristic is considered to be good if "pinhole sheeting" is observed. Sheeting characteristic is considered to be moderate if "pinhole sheeting" and "no sheeting" are both observed on different locations on the surface of a substrate. Sheeting characteristic is considered to be poor if no sheeting is observed.

Foaming is evaluated by measuring the foam height (with a ruler) on top of the rinse solution after the warewashing machine is stopped. The aqueous rinse solution is categorized as "very low foaming" if no foam or only a trace of foam is observed. The aqueous rinse solution is categorized as "low foaming" if one-quarter to one-half (0.5 cm to 1 cm) inch of foam is observed. The aqueous rinse solution is categorized as "moderately foaming" if one to two inches (2.5 cm to 5 cm) of foam is observed. The aqueous rinse solution is categorized as "high foaming" if more than about three inches (7 cm) of foam is observed.

Various surfactants, such as certain of the APGs shown in Table 1, the reverse polyoxyalkylene block copolymers shown in Table 2, and combinations of such surfactants in various ratios were evaluated for their sheeting and foaming characteristics. Table 4 show examples of the surfactants and combinations of surfactants evaluated.

TABLE 4

| Surfactants Evaluated for Sheeting Characteristics |
|---|
| APG 625 |
| APG 225 |
| APG 625:PLURONIC 25R2 at 1:1 ratio |
| APG 625:Polymer-3 at 1:1 ratio |
| APG 625:Polymer-3 at 3:1 ratio |
| APG 625:TETRONIC 90R4 at 1:1 ratio |
| APG 625:GENAPOL PN30 at 1:1 ratio |
| APG 625:TETRONIC 50R4 at 1:3 ratio |
| APG 625:Polymer-9 at 1:1 ratio |
| APG 550:Polymer-10 at 1:1 ratio |
| APG 625:Polymer-2 at 1:3 ratio |
| Polymer-2 |
| APG 625:Polymer-1 at 1:1 ratio |
| APG 625:Polymer-1 at 1:3 ratio |
| Polymer-1 |
| APG 625:Polymer-11 at 1:3 ratio |
| Polymer-11 |
| APG 625:PLURONIC L10 at 1:1 ratio |
| PLURONIC L10 |
| APG 625:Polymer-10 at 1:1 ratio |
| Polymer-10 |
| Formula-1 |
| Formula-2 |
| Formula-5 |
| Formula-6 |
| Formula-7 |

Each composition (individual surfactant or combination) was evaluated at different concentrations (from about 20 ppm to 250 ppm by weight of rinse additive active surfactants to rinse solution) to observe the sheeting and foaming characteristics. The sheeting evaluation of the aqueous rinse solutions were done on polycarbonate dishes, polycarbonate tiles, glass, glass plates, MELAMINE plates, china plates, polypropylene plates, smooth polypropylene cups, rough polypropylene cups, polypropylene trays, polyester trays, polysulfone dishes, polysulfone spoons, and stainless steel knives.

The results of the evaluation showed that APGs were very foamy (i.e., high foaming). All of the reverse —$(EO)_e$—$(PO)_p$ block copolymers evaluated were shown to be effective in reducing foaming to a desirable level when combined with APG. Among the reverse —$(EO)_e$—$(PO)_p$ block copolymers, $(PO)_z$—$(EO)_y$—$(PO)_x$—$(EO)_y$—$(PO)_z$ block copolymers were especially effective in reducing foaming when used with APGs. Combinations of the reverse —$(EO)_e$—$(PO)_p$ block copolymers with APGs, especially $(PO)_z$—$(EO)_y$—$(PO)_x$—$(EO)_y$—$(PO)_z$ with APG 625, exhibited synergistic enhancement in sheeting performance as described below.

The evaluation showed that, utilizing service water to make the aqueous rinse solution, solutions containing both reverse —$(EO)_e$—$(PO)_p$ block copolymers and APG resulted in better sheeting characteristics than utilizing the reverse —$(EO)_e$—$(PO)_p$ block copolymer or APG alone. Likewise, utilizing softened service water to make the aqueous rinse solution, an aqueous rinse solution containing APG and a straight-chain reverse —$(EO)_e$—$(PO)_p$ block copolymer resulted in better sheeting characteristic than an aqueous rinse solution containing APG per se or the straight chain reverse —$(EO)_e$—$(PO)_p$ block copolymer per se. Using the same formulation of an aqueous rinse solution containing APG and reverse —$(EO)_e$—$(PO)_p$ block copolymers, an aqueous rinse solution made with softened service water had better sheeting characteristics than one made with service water. The evaluation further showed that a wt/wt ratio of 3:1 of APG to the reverse —$(EO)_e$—$(PO)_p$ block copolymer in the aqueous rinse solution resulted in good sheeting characteristic and adequate or moderate foaming characteristic but decreasing the ratio improved the low-foaming characteristic. A ratio of 1:1 resulted in good overall sheeting and low-foaming characteristics, and a ratio of 1:3 resulted in the best overall sheeting and low-foaming results. Multibranched reverse polyoxyalkylene block copolymers, such as TETRONIC 90R4, TETRONIC 50R4, GENAPOL PN30, and Polymer-10, were also shown to be effective to produce good sheeting and low-foaming characteristics when used in combination with APG.

When compared with commercially available rinse aids such as A, B, C, and D, the sheeting characteristics of formulations containing APGs and reverse polyoxyalkylene block copolymers demonstrated comparable or superior sheeting and low-foaming characteristics.

B. Evaluation of thermoplastic-compatibility

A screening evaluation was used for evaluating the damage caused by surfactant on thermoplastics such as polycarbonate and polysulfone. Thermoplastic strips with very low built-in internal stress were used. The strips were maintained at room temperature or elevated temperatures before evaluation. A drop of a surfactant or a formulation of surfactants, such as those of Table 4, was placed on flexurally strained strips of polycarbonate and polysulfone. The strips were maintained at the starting temperature and observed for damage over time. Evidence of the occurrence of stress cracks and breakage was identified to indicate the compatibility of the surfactants and formulations with the thermoplastic strips. The result showed that APGs are moderately safe on (i.e., are moderately compatible with) polycarbonate and polysulfone. Reverse —$(EO)_e$—$(PO)_p$ block copolymers are moderately compatible with polycarbonate and polysulfone. Reverse —$(EO)_e$—$(PO)_p$ block copolymers are more compatible with polycarbonate and polysulfone than the respective regular (or normal) type —$(EO)_e$—$(PO)_p$ block copolymers with end blocks of —$(EO)_e$. Even though polycarbonate and polysulfone were evaluated as examples for showing the compatibility of the invention with plastic kitchen ware, the invention may be applied on other thermoplastic surfaces which are susceptible to stress cracking in warewashing.

Example II

Compatibility of APG/Reverse —$(EO)_e$—$(PO)_p$ Block

Copolymer Rinse Aid Solutions with Plastics

Example II is an evaluation which shows the compatibility of the rinse aids of the present invention with thermoplastics such as polysulfone and polycarbonate.

Flexurally-strained (by bending to imposing stress) strips of thermoplastics, such as polycarbonate and polysulfone, were immersed in surfactant-containing solutions at elevated temperature of 77° C. (170° F.) for 4 hours and the tensile elongation at break point was measured. These strips are dog-bone-biscuit-shaped pieces with uniform thickness having enlarged ends connected to a long, narrow, middle portion. Polycarbonate strips 0.2 cm thick having a middle portion of 6.35 cm by 1.02 cm (with a total end-to-end length of 10.16 cm) and polysulfone strips 0.31 cm thick having a middle portion of 10.16 cm by 1.27 cm (with a total end-to-end length of 19.05 cm) were used. When a strip was to be evaluated for tensile elongation at break point using an INSTRON tensile strength evaluation machine, the enlarged ends were each held by a pair of jaws and the middle portion was then stretched.

The method disclosed in Mobay Technical Marketing Information, "Chemical Compatibility Test for Unreinforced Thermoplastic Resins," which is incorporated by reference herein, was used to evaluate the thermoplastic-compatibility of the surfactant-containing solution. Briefly stated, in this method, a strip is clamped down on a stainless steel fixture with a specific curvature to produce a stress on the strip and immersed in a selected solution. The amount of strain is proportional to the degree of bending of the strip according to the following formula:

$$E_{max}(\%) = \frac{T}{2R+T} \times 100$$

where $E_{max}$ is the maximum applied strain in the specimen in percent, T is the thickness of the specimen, and R is the radius of the curvature of the fixture.

The solutions to be evaluated for thermoplastic compatibility each contain about 125 ppm by weight of rinse additive active surfactants on rinse solution. Such a concentration was found to be effective to produce desired sheeting characteristics for the rinse aid of the present invention (based on the evaluation, including that of Example I). The conditions for evaluating thermoplastic compatibility of the rinse aids, such as surfactant concentration and temperature, were typical of warewashing machine rinsing conditions.

After immersion, the strips were rinsed thoroughly with water and then conditioned for at least three (3) days at 23° C. under 50% relative humidity. The strips were then examined visually and evaluated for stress-strain relations with an INSTRON tensile strength evaluation machine. The INSTRON machine evaluation is conducted by holding the two enlarged ends of the test strip with jaws and stretching the strip with a constant testing (or crosshead) speed, while the tension (load) is monitored continuously. The strip is stretched until the strip breaks. The elongation of the strip before it breaks is measured, which is called elongation-at-break. The Instron evaluation provides information on the mechanical integrity of the strip. Generally, the elongation-at-break bears a very sensitive inverse relation to the damage sustained. The more damage sustained by the strip during the immersion of the strip in the surfactant-containing solution, the shorter the elongation-at-break. Exemplary results of the evaluation are shown in Table 5 and Table 6.

In evaluating the plastic compatibility of a rinse aid (or surfactant or combination of surfactants), the rinse aid is categorized as having good thermoplastic compatibility if by applying the above plastic compatibility evaluation method at the 1% strain level on a polycarbonate strip, the strip has an elongation-at-break of 1 cm or more afterwards. Qualitatively, a rinse aid can be considered thermoplastic-compatible if it demonstrates better elongation-at-break data for polycarbonate test strips tested at 1% applied strain level than the commercially available rinse aid JET DRY using the above evaluation procedure. Generally, a rinse aid that is more compatible to polycarbonate than another rinse aid is also more compatible to other thermoplastics, e.g. polysulfone, than that other rinse aid.

TABLE 5

Surfactant Effect on Polycarbonate, Elongation-at-Break (cm)

| | Applied Strain by Bending (%) | | | |
|---|---|---|---|---|
| Rinse Solution | 0 | 0.6 | 1.0 | 1.6 |
| Service water | 6.6 | 5.8 | 5.6 | 4.5 |
| APG 625 | 7.4 | 7.0 | 0.6 | 0.5 |
| Polymer-1 | 6.8 | 4.8 | 2.4 | 0.5 |
| Polymer-2 | 6.8 | 3.9 | 0.5 | 0.7 |
| APG625:Polymer-2 (1:3) | 7.6 | 5.9 | 4.2 | 0.4 |
| Formula-1 | 4.2 | 6.3 | 4.1 | 2.0 |
| Formula-2 | 7.4 | 7.4 | 2.8 | 3.9 |
| Formula-4 | 6.9 | 5.7 | 3.2 | 1.9 |
| Formula-5 | 7.6 | 7.5 | 3.6 | 0.6 |
| Formula-6 | 6.8 | 7.6 | 5.3 | 3.2 |
| Formula-8 | 6.4 | 7.1 | 3.5 | 0.6 |

TABLE 6

Surfactant Effect on Polysulfone, Elongation-at-Break (cm)

| | Applied Strain by Bending (%) | | | | |
|---|---|---|---|---|---|
| Rinse Solution | 0 | 0.2 | 0.4 | 0.6 | 0.8 |
| Service water | 10.1 | 10.1 | 9.0 | 8.6 | 7.2 |
| Formula-6 | 10.6 | 10.0 | 11.6 | 10.3 | 0.76 |

Table 5 shows the surfactant effect (i.e., damage) on polycarbonate by various surfactants and combinations of surfactants at a concentration of 125 ppm active surfactants in the solution under evaluation. The surfactants and combination of surfactants listed in Table 5 are APG 625, Polymer-1 and Polymer-2 of Table 2, Formula-1, Formula-2, Formula-4, Formula-5, Formula-6, and Formula-8 of Table 3; as well as a 3:1 combination of Polymer-2 and APG 625.

APG 625, a mixture of polyglycosides represented by the general formula:

$$C_nH_{2n+1}O(C_6H_{10}O_5)_x$$

wherein n is 12, 14, or 16, with an average value of 12.8 and x has an average value of 1.6, is supplied as a 50% aqueous solution by the Energy Group of Henkel Corp. The structure of the reverse —$(EO)_e$—$(PO)_p$ block copolymers used in the evaluation are given in Table 2. Table 5 shows the surfactant damage on polycarbonate by aqueous rinse solution at a rinse agent active surfactants concentration of 125 ppm, which is a concentration comparable to that of aqueous rinse solutions employing commercially available rinse aids such as JET DRY. Table 6 shows the surfactant damage on polysulfone by aqueous rinse solution of Formula-6 at a rinse agent active surfactants concentration of 125 ppm. The detailed list of ingredients for the formulations of the surfactants and combinations of surfactants of Table 5 and Table 6 are shown in Table 3. As previously stated, the formulations with both APG and the reverse block copolymer were similar or more effective in sheeting when compared with rinse solutions prepared from commercially available rinse aids.

Table 5 shows that with no strain, APG 625, Polymer-1, and Polymer-2 performed comparably well as service water in causing damage to polycarbonate strip. At a low applied strain of 0.6%, the combinations of APG and reverse polyoxyalkylene block copolymer performed as well as APG per se and service water per se and better than the reverse polyoxyalkylene block copolymers per se. At about 1% applied strain, the combinations of APG and reverse polyoxyalkylene block copolymer performed better than APG per se and the reverse polyoxyalkylene block copolymers per se. Most of such combinations performed comparably well with service water. At 1.6% applied strain, although not performing quite as well as service water, the combinations of APG and reverse polyoxyalkylene block copolymer performed better than the APG per se and the reverse polyoxyalkylene block copolymers per se. In summary, Table 5 shows the synergistic effect of combining APG and reverse polyoxyalkylene block copolymer in inhibiting stress cracking in polycarbonate.

Table 6 shows the effect of a rinse aid, Formula-6 on polysulfone. Table 6 shows an example of the combination of APG and reverse polyoxyalkylene block copolymer which performed comparably well with service water in polysulfone-compatibility up to applied strain of 0.6%, which was similar to the results of the evaluation of aqueous rinse solutions on polycarbonate listed in Table 5. The combinations of APG and reverse polyoxyalkylene block copolymer would exhibit similar superior compatibility to polysulfone as to polycarbonate.

Based on the immersion evaluation, for example, those shown in Table 5 and Table 6, it was found that APGs and the reverse $—(EO)_e—(PO)_p$ block copolymers individually are moderately thermoplastic-compatible, i.e., moderately safe to use on, for example, polycarbonate and polysulfone. Combinations of APGs with the reverse $—(EO)_e—(PO)_p$ block copolymers are more compatible with these plastics than the individual components, i.e., resulting in less damage. These combinations displayed elongation-at-break of 1 cm or more when evaluated on polycarbonate using the above method, and many displayed elongation-at-break of 3 cm or more.

The rinse aids of TABLE 3 were evaluated and compared with commercially available rinse aids, A, B, C, and D, at comparable concentrations. The rinse aids containing combination of APG and the reverse $—(EO)_e—(PO)_p$ block copolymers were found to be compatible with thermoplastics such as polycarbonate and polysulfone. They were found to have superior thermoplastic compatibility as well as sheeting performance compared to the above commercially available rinse aids.

The data in Example I and II were presented as embodiments for illustrating how the invention can be practiced and should not be understood as limits of the scope and claims of the invention.

All percentages and ratios are by weight unless indicated otherwise. Although characteristics and advantages, together with details for structure, materials, function and process steps have been described in reference to preferred embodiments herein, it is understood that the disclosure is illustrative. Various alterations and modifications can be made or will be apparent to one skilled in the art without departing from the scope and spirit of the present invention.

What is claimed is:

1. An aqueous rinse aid, comprising:

(a) about 5–10 wt-% of an alkyl polyglycoside; and (b) about 5–40 wt-% of a nonionic, reverse, polyoxyethylene-containing polyoxyalkylene block copolymer having an ethylene oxide content of less than about 50 wt-% of the copolymer comprising $—(EO)_x—(PO)_y$, wherein EO is ethylene oxide, PO is propylene oxide, x is from 1 to 1000, and y is from 1 to 500, wherein the rinse aid upon dilution with water results in an aqueous rinse solution having desired sheeting, low-foaming characteristics and compatibility with plasticware.

2. The rinse aid of claim 1, wherein the alkyl polyglycoside comprises one to three reducing saccharide units, each of which containing 5 or 6 carbon atoms, and an aliphatic moiety containing 5 to 30 carbon atoms.

3. The rinse aid of claim 1, wherein the reverse polyoxyethylene-containing block copolymer has a formula of $$(PO)_y(EO)_x(PO)_y$$

wherein x is from 1 to 100 and y is from 1 to 500.

4. The rinse aid of claim 3, wherein x is from 4 to 230 and y is from 8 to 27.

5. The rinse aid of claim 1, wherein the reverse polyoxyethylene-containing block copolymer has a formula of $$((PO)_y(EO)_x)_2T((EO)_x(PO)_y)_2$$

wherein T is a tetrafunctional linking moiety, x is from 1 to 500, and y is from 1 to 500.

6. The rinse aid of claim 5, wherein x is from 1 to 100 and y is from 8 to 32.

7. The rinse aid of claim 1, wherein the reverse polyoxyethylene-containing block copolymer has a formula of $$(PO)_z(EO)_y(PO)_x(EO)_y(PO)_z,$$

wherein x is from 1 to 1000, y is from 1 to 500, and z is from 1 to 500.

8. The rinse aid of claim 7, wherein x is from 7 to 21, y is from 10 to 20, and z is from 5 to 20.

9. The rinse aid of claim 1, wherein the reverse polyoxyethylene-containing block copolymer has a formula of $$T((PO)_x(EO)_y(PO)_z)_3$$

wherein T is a trifunctional linking moiety, x is from 0 to 500, y is from 1 to 500, and z is from 1 to 500.

10. The rinse aid of claim 9, wherein x is from 0 to 10, y is from 5 to 12, and z is from 5 to 10.

11. The rinse aid of claim 9, wherein the block copolymer has the formula of $$N\{(CH_2CH_2O)\ (PO)_x(EO)_y(PO)_x\}_3.$$

12. The rinse aid of claim 9, wherein the block copolymer has the formula of

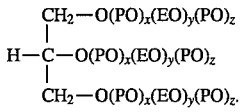

13. An aqueous rinse aid comprising:

(a) an alkyl polyglycoside which comprises one to three reducing saccharide units, each of which containing 5 or 6 carbon atoms, and a saturated or unsaturated fatty aliphatic group containing 5 to 30 carbon atoms, and the alkyl polyglycoside constitutes 5% to 10% by weight of the rinse aid; and (b) a nonionic, reverse polyoxyalkylene block copolymer comprising $—(EO)_x—(PO)_y$ wherein x is 5 to 20 and y is 5 to 20, and the nonionic, reverse polyoxyalkylene block copolymer constitutes 5% to 40% of the rinse aid and the EO content is less than about 50 wt-% of the copolymer;

wherein the rinse aid, when diluted with water in a ratio of rinse aid:water of 5 ppm to 10,000 ppm by weight, results in an aqueous rinse solution having desired sheeting, low-foaming characteristics, and compatibility with plasticware.

14. An aqueous rinse solution comprising:

(a) an alkyl polyglycoside; and (b) a nonionic, reverse, polyoxyethylene-containing polyoxyalkylene block copolymer having an ethylene oxide content of less than about 50 wt-% of the copolymer, wherein the ratio of polyglycoside to copolymer is about 1:1 to 1:8; and wherein the aqueous rinse solution has desired sheeting, low-foaming characteristics and compatibility with thermoplastics.

15. The aqueous rinse solution of claim 14, wherein the alkyl polyglycoside comprises one to three reducing saccharide units, each of which containing 5 or 6 carbon atoms and a saturated or unsaturated fatty aliphatic group containing 5 to 30 carbon atoms.

16. The aqueous rinse solution of claim 14, wherein the reverse, polyoxyethylene-containing polyoxyalkylene block copolymer comprises polyoxyethylene-polyoxypropylene block copolymer.

17. The aqueous rinse solution of claim 16, wherein (a) the alkyl polyglycoside constitutes 5 to 10,000 ppm of the aqueous rinse solution, and (b) the reverse polyoxyethylene-polyoxypropylene block copolymer constitutes 5 to 10,000 ppm of the aqueous rinse solution.

18. The aqueous rinse solution of claim 17, wherein (a) the alkyl polyglycoside constitutes 20 to 200 ppm of the aqueous rinse solution, and (b) the reverse polyoxyethylene-polyoxypropylene block copolymer constitutes 20 to 200 ppm of the aqueous rinse solution.

19. An aqueous rinse solution comprising:

(a) an alkyl polyglycoside which comprises one to three reducing saccharide units, each of which containing 5 or 6 carbon atoms, and a saturated or unsaturated fatty aliphatic group containing 5 to 30 carbon atoms, the alkyl polyglycoside constitutes 5 to 10,000 ppm of the aqueous rinse solution; and (b) a nonionic, reverse polyoxyalkylene block copolymer which comprises $—(EO)_x(PO)_y$ wherein x is 5 to 20 and y is 5 to 20, the nonionic, reverse polyoxyalkylene block copolymer constitutes 5 to 10,000 ppm of the aqueous rinse solution;

wherein the aqueous rinse solution has desired sheeting, low-foaming characteristics, and compatibility with plasticware.

20. A method of cleaning plasticware, comprising:

(a) contacting the plasticware with an aqueous cleaning agent in a ware washing machine to produce cleaned ware; and (b) contacting the cleaned ware with an aqueous rinse solution, the aqueous rinse solution comprising:

(A) about 5–10 wt-% of an alkyl polyglycoside;

(B) about 5–40 wt-% of a nonionic, reverse polyoxyethylene-containing polyoxyalkylene block copolymer having an ethylene oxide content of less than about 50 wt-% of the copolymer;

wherein the aqueous rinse solution has desired sheeting, low-foaming characteristics and compatibility with plasticware.

* * * * *

UNITED STATES PATENT AND TRADEMARK OFFICE
CERTIFICATE OF CORRECTION

PATENT NO. : 5,501,815

DATED : March 26, 1996

INVENTOR(S) : Victor F. Man

It is certified that error appears in the above-identified patent and that said Letters Patent is hereby corrected as shown below:

In Column 2, line 29, "$C_2$" should read --$C_{1-12}$--.

In Column 6, line 32, "$(EO_3)$" should read --(EO) e- --.

In Table 2, Column 8, lines 10 and 12, "___$(EO)_{16.5}$" should read --$(EO)_{8.5}$--.

In Column 9, line 31, "$(BO)_p$" should read --$(BO)_b$--.

In Column 11, line 9, "Hydrotroyes" should read --Hydrotropes--.

In Column 19, Claim 14, lines 32 and 33, "thermoplastics" should read --plasticware--.

Signed and Sealed this

Twenty-second Day of October, 1996

*Attest:*

Bruce Lehman

BRUCE LEHMAN

*Attesting Officer*

*Commissioner of Patents and Trademarks*